US012577776B2

(12) United States Patent
Felton

(10) Patent No.: US 12,577,776 B2
(45) **Date of Patent: *Mar. 17, 2026**

(54) INTERLOCKING COMPOSITE CONSTRUCTION BLOCK

(71) Applicant: ComposiTech LLC, Coos Bay, OR (US)

(72) Inventor: Colin Christopher Felton, Coos Bay, OR (US)

(73) Assignee: ComposiTech LLC, Coos Bay, OR (US)

( * ) Notice: Subject to any disclaimer, the term of this patent is extended or adjusted under 35 U.S.C. 154(b) by 305 days.

This patent is subject to a terminal disclaimer.

(21) Appl. No.: 17/430,245

(22) PCT Filed: Feb. 25, 2020

(86) PCT No.: PCT/US2020/019733

§ 371 (c)(1),
(2) Date: Aug. 11, 2021

(87) PCT Pub. No.: WO2020/176530

PCT Pub. Date: Sep. 3, 2020

(65) Prior Publication Data

US 2022/0136238 A1 May 5, 2022

Related U.S. Application Data

(60) Provisional application No. 62/919,084, filed on Feb. 26, 2019.

(51) Int. Cl.
*E04B 2/16* (2006.01)
*E04B 2/18* (2006.01)
(Continued)

(52) U.S. Cl.
CPC ..... *E04B 2/18* (2013.01); *E04C 1/397* (2013.01); *E04C 1/40* (2013.01); *E04B 2002/023* (2013.01)

(58) Field of Classification Search
CPC ..... E04B 2/18; E04B 2/20; E04B 2002/023; E04C 1/397; E04C 1/40
(Continued)

(56) References Cited

U.S. PATENT DOCUMENTS 2,676,482 A * 4/1954 Wilson ..... E04B 2/48 52/564
2,805,448 A * 9/1957 Rubenstein ..... E04C 1/40 174/521
(Continued)

FOREIGN PATENT DOCUMENTS

AU 2009101156 A4 2/2010
BE 479632 A 7/1948
(Continued)

OTHER PUBLICATIONS

International Preliminary Report on Patentability dated Aug. 25, 2021 in corresponding PCT Application No. PCT/US2020/019733 in 6 pages.
(Continued)

*Primary Examiner* — Brian D Mattei
*Assistant Examiner* — Joseph J. Sadlon
(74) *Attorney, Agent, or Firm* — Knobbe, Martens, Olson & Bear, LLP

(57) ABSTRACT

Embodiments relate to an enhanced method for building walls by primarily reducing the time for assembly. The design is for a molded multi-segment plastic composite construction block that interlocks horizontally, vertically and orthogonally with a clearance-fit, does not require mortar for structural integrity and is self-aligning. The
(Continued)

blocks are molded out of natural-fiber reinforced thermoplastic composites with thermal expansion coefficient less than 0.0002 per degree Celsius and compression strength greater than 60 MPa.

20 Claims, 10 Drawing Sheets

(51) Int. Cl.
*E04C 1/39* (2006.01)
*E04C 1/40* (2006.01)
*E04B 2/02* (2006.01)
*E04B 2/24* (2006.01)

(58) Field of Classification Search
USPC ..... 52/596
See application file for complete search history.

(56) References Cited

U.S. PATENT DOCUMENTS 3,005,282 A 10/1961 Kirk
3,237,357 A * 3/1966 Hutchings ..... E04B 1/06 52/223.6
3,313,073 A * 4/1967 Mathews ..... F16L 59/04 52/309.7
3,373,668 A * 3/1968 Moore ..... E01C 5/16 47/33
3,449,878 A * 6/1969 Hern ..... E04C 1/40 D25/4
3,488,881 A * 1/1970 Holzer ..... A63H 33/08 446/95
3,537,687 A * 11/1970 Adelman ..... E02D 29/0266 47/33
3,742,985 A * 7/1973 Rubenstein ..... F16L 9/08 138/155
3,879,908 A * 4/1975 Weismann ..... B21F 27/128 52/577
3,905,170 A 9/1975 Huettemann
4,041,670 A * 8/1977 Kaplan ..... E04B 2/18 52/592.2
4,132,043 A 1/1979 Juba
4,155,787 A * 5/1979 DeSadier ..... F17C 13/001 52/249
4,231,198 A * 11/1980 Augier ..... E04B 1/21 403/174
4,253,509 A * 3/1981 Collet ..... F16B 41/005 411/397
4,427,818 A * 1/1984 Prusinski ..... C08J 11/06 52/DIG. 9
4,434,200 A * 2/1984 Fash ..... D06M 11/44 442/46
4,441,944 A 4/1984 Massey
4,501,830 A 2/1985 Miller et al.
4,565,043 A * 1/1986 Mazzarese ..... E04C 1/392 52/603
4,566,238 A * 1/1986 Janopaul, Jr. ..... E04B 1/7604 52/404.3
4,608,795 A * 9/1986 Neuschaeffer ..... E04C 2/288 52/591.1
4,703,600 A * 11/1987 Suh ..... E04C 1/39 52/437
4,793,104 A * 12/1988 Hultberg ..... E04C 1/42 52/127.3
4,821,483 A 4/1989 Adams
4,903,451 A * 2/1990 Gresswell ..... A47B 87/0276 52/584.1
4,925,330 A * 5/1990 Cornish ..... E04G 17/04 403/174
5,274,968 A * 1/1994 Pardo ..... E04C 1/39 52/505
5,302,634 A 4/1994 Mushovic
5,312,858 A * 5/1994 Folsom ..... E04B 2/06 523/129
5,389,167 A 2/1995 Sperber
5,471,808 A 12/1995 De Pieri et al.
5,609,680 A * 3/1997 Kobayashi ..... B28B 11/04 524/4
5,743,330 A * 4/1998 Bilotta ..... F24D 3/141 165/171
5,755,216 A * 5/1998 Salyer ..... E04C 1/41 126/618
5,775,046 A 7/1998 Fanger et al.
5,921,046 A 7/1999 Hammond, Jr.
6,030,446 A 2/2000 Doty et al.
6,050,749 A * 4/2000 Khamis ..... E02D 29/0225 405/262
6,065,265 A * 5/2000 Stenekes ..... E04B 2/46 52/421
6,110,575 A * 8/2000 Haga ..... E04C 2/043 428/921
6,161,357 A * 12/2000 Altemus ..... E04B 2/24 446/124
6,167,669 B1 1/2001 Lanc
6,212,845 B1 * 4/2001 De Zen ..... E04B 1/12 52/144
6,213,754 B1 4/2001 Doty
6,266,940 B1 * 7/2001 Reichert ..... E06B 3/66361 52/786.13
6,284,089 B1 9/2001 Anderson et al.
6,295,778 B1 * 10/2001 Burt ..... E04C 2/52 52/592.1
6,355,333 B1 * 3/2002 Waggoner ..... E04B 1/62 52/630
6,444,162 B1 9/2002 Anshits et al.
6,565,942 B2 * 5/2003 Anderson ..... B29C 65/18 428/116
6,720,069 B1 * 4/2004 Murakami ..... G10K 11/16 428/218
6,821,609 B2 11/2004 Mende et al.
6,827,995 B2 * 12/2004 Hughes ..... B29C 48/338 428/36.5
6,883,281 B1 * 4/2005 Chavez-Gandara ..... E04B 2/44 52/223.7
6,926,077 B2 * 8/2005 Kuga ..... F24D 3/16 165/172
6,976,345 B2 12/2005 Keshmiri
6,983,571 B2 1/2006 Felton
7,000,729 B2 * 2/2006 Jacobsen ..... E04B 1/84 181/290
7,596,916 B1 * 10/2009 Anderson ..... E04B 2/702 52/286
7,694,485 B1 * 4/2010 Siener ..... E04B 2/18 52/592.6
7,743,565 B2 * 6/2010 Pyo ..... B28B 7/42 52/220.1
7,765,759 B2 * 8/2010 Au ..... E04B 2/8629 52/432
7,793,471 B2 * 9/2010 Hill ..... E04F 15/087 428/44
7,882,673 B1 2/2011 Hohmann, Jr.
7,963,080 B1 * 6/2011 Bowman ..... B32B 27/42 52/309.7
8,042,309 B2 10/2011 Wolf et al.
8,043,982 B2 10/2011 Telander
8,057,594 B2 11/2011 Doyoyo et al.
8,069,629 B2 12/2011 Rockwell et al.
8,091,300 B2 * 1/2012 Pyo ..... B28B 7/42 52/79.9
8,091,314 B2 * 1/2012 Polk, Jr. ..... E04C 2/427 52/582.1
8,099,918 B2 * 1/2012 Marsh ..... E04B 2/30 52/293.3
8,176,697 B1 * 5/2012 Bolander, II ..... E04G 21/185 52/309.4
8,349,444 B2 1/2013 Kipp et al.
8,431,214 B2 * 4/2013 Chakrabarti ..... B32B 3/08 428/223
8,440,296 B2 5/2013 Kipp et al.

(56) References Cited

U.S. PATENT DOCUMENTS 8,443,560 B2 * 5/2013 Uhl ..... E04B 2/8635 52/568
8,445,101 B2 5/2013 Kipp et al.
8,512,841 B2 * 8/2013 Ford ..... E04D 13/1656 428/40.1
8,512,853 B2 * 8/2013 Chakrabarti ..... E04C 2/296 428/223
8,545,748 B2 10/2013 Alsewailem
8,591,677 B2 11/2013 Kipp et al.
8,640,410 B2 * 2/2014 Bergeron ..... E04B 1/14 52/592.1
8,752,348 B2 6/2014 Bowman
8,857,125 B2 * 10/2014 Lu ..... B27M 3/002 52/581
8,904,732 B2 12/2014 Chen et al.
8,940,383 B2 1/2015 Vogel
8,973,337 B2 * 3/2015 Hires ..... E04C 2/36 52/794.1
9,010,052 B2 4/2015 Cetindag
9,103,470 B2 8/2015 Cik
9,151,051 B2 * 10/2015 Cossette ..... E04C 5/073
9,194,120 B2 * 11/2015 Van Pottelbergh ..... B68G 1/00
9,248,492 B2 * 2/2016 Sullivan ..... F24D 3/142
9,499,981 B2 * 11/2016 Grisolia ..... B32B 27/12
9,540,808 B2 * 1/2017 Remmele ..... E04B 2/02
9,689,160 B2 * 6/2017 Lanese ..... E04B 2/08
9,732,524 B2 8/2017 Grundy et al.
9,783,986 B2 10/2017 Yesil
9,828,769 B2 * 11/2017 Ariba ..... E04B 2/14
9,981,443 B2 5/2018 Sumi et al.
10,077,553 B2 * 9/2018 Neumayr ..... E04B 1/14
10,113,305 B2 * 10/2018 Radford ..... E04C 1/39
10,155,210 B2 * 12/2018 Russell ..... B01J 8/008
10,352,059 B2 7/2019 Vaidya et al.
10,358,819 B2 7/2019 Tanami
10,414,140 B2 9/2019 Zacarias et al.
10,458,117 B2 10/2019 Wang
10,526,783 B2 1/2020 Hon
10,527,293 B2 1/2020 Alsberg
10,538,916 B1 * 1/2020 Al-Amoudi ..... E04C 1/41
10,626,599 B2 4/2020 Negev
10,836,679 B2 11/2020 Wieteska et al.
10,876,291 B2 * 12/2020 Yesil ..... E04C 1/00
10,988,939 B2 * 4/2021 Van Vlassenrode .... B32B 9/045
11,149,446 B2 * 10/2021 Baert ..... E04F 15/107
11,225,792 B2 1/2022 Robak
11,408,182 B2 8/2022 Felton et al.
11,529,751 B2 12/2022 Asprone et al.
11,608,633 B2 * 3/2023 Pivac ..... C04B 28/02
2001/0023559 A1 * 9/2001 Ozawa ..... B28B 7/364 52/441
2003/0096096 A1 5/2003 Jo et al.
2003/0115820 A1 * 6/2003 Assadi ..... B65D 19/0012 52/309.1
2003/0150185 A1 * 8/2003 Godeke ..... E04C 1/41 52/576
2003/0154662 A1 * 8/2003 Bruchu ..... E04F 15/02194 52/87
2003/0170445 A1 9/2003 Parrish
2004/0009338 A1 * 1/2004 Jo ..... B29C 70/506 428/297.4
2004/0179903 A1 9/2004 Rainey et al.
2004/0221538 A1 * 11/2004 Thorpe ..... E04C 1/397 52/596
2005/0019545 A1 * 1/2005 Riebel ..... C08L 89/00 428/343
2006/0205846 A1 * 9/2006 Spitz ..... C08J 3/201 524/13
2007/0011964 A1 * 1/2007 Smith ..... E04B 1/4178 52/285.3
2007/0062146 A1 * 3/2007 Van Dijk ..... E04C 2/22 52/580
2007/0107364 A1 * 5/2007 Estes ..... E04B 2/16 52/606
2007/0125016 A1 * 6/2007 Yu ..... E04B 2/7425 52/220.7
2008/0184642 A1 8/2008 Sebastian et al.
2008/0203365 A1 8/2008 Gleeson
2008/0307735 A1 * 12/2008 Trimmer ..... E04G 17/047 248/220.21
2009/0004459 A1 1/2009 Kipp et al.
2009/0101306 A1 * 4/2009 Reis ..... H05B 3/283 165/56
2009/0173027 A1 * 7/2009 Bennett ..... E04C 1/40 52/596
2009/0193742 A1 * 8/2009 Wolf ..... B29C 39/36 52/311.1
2009/0239059 A1 9/2009 Kipp et al.
2009/0249719 A1 10/2009 Broehl et al.
2009/0308001 A1 * 12/2009 Wu ..... E04F 13/0885 52/173.3
2009/0314848 A1 * 12/2009 Andersson ..... F24D 3/148 165/56
2010/0101168 A1 * 4/2010 Hohmann, Jr. ..... E04B 1/7046 52/513
2010/0183840 A1 7/2010 Logan et al.
2011/0072751 A1 * 3/2011 Clear ..... E04C 5/168 52/678
2011/0160104 A1 6/2011 Wu et al.
2011/0239578 A1 10/2011 Wolf et al.
2012/0000874 A1 * 1/2012 Calleja ..... E04B 1/24 211/182
2012/0233935 A1 * 9/2012 Phillips ..... E04B 2/08 52/169.9
2012/0260594 A1 * 10/2012 Blackstock ..... C04B 28/006 52/750
2012/0267067 A1 * 10/2012 Sullivan ..... B29C 44/445 428/167
2013/0015389 A1 1/2013 Torres-Aranda, Jr.
2013/0036696 A1 * 2/2013 Moroschan ..... E04B 2/16 52/745.1
2013/0055736 A1 * 3/2013 Everett ..... F24F 5/0021 62/271
2013/0205688 A1 8/2013 Muirhead
2013/0205703 A1 8/2013 Baumer
2014/0026505 A1 * 1/2014 Cetindag ..... E04C 1/40 52/309.13
2015/0152650 A1 6/2015 Cernohous et al.
2016/0097234 A1 * 4/2016 Fagan ..... E06B 1/52 52/309.4
2017/0016228 A1 1/2017 Hashemian
2017/0268226 A1 * 9/2017 Graniglia ..... E04B 2/18
2018/0347187 A1 12/2018 Parks et al.
2019/0127976 A1 * 5/2019 Donnelly ..... A63H 33/107
2019/0316294 A1 * 10/2019 Medoff ..... C10G 1/02
2020/0063981 A1 * 2/2020 Alsberg ..... F24D 3/141
2020/0283608 A1 * 9/2020 Chianese ..... E04C 2/26
2021/0071416 A1 * 3/2021 Marshall ..... E04C 2/06
2023/0287679 A1 9/2023 Felton et al.

FOREIGN PATENT DOCUMENTS

BR PI0607289 A2 8/2009
BR 112015023237 A2 7/2017
CH 667485 A * 10/1988 ..... E04C 1/397
CH 680600 A5 * 9/1992 ..... E04B 1/10
CN 1975000 A * 6/2007
DE 2450475 A1 4/1976
DE 3246621 A1 6/1984
DE 102006008147 A1 8/2007
DE 102007061451 A1 7/2009
EP 0103192 A2 * 3/1984 ..... E04C 1/42
EP 0103192 B1 6/1986
EP 0882849 A2 * 12/1998 ..... E04B 5/04
ES 2354091 A1 * 3/2011 ..... E04C 1/397
FR 1121616 A * 8/1956 ..... E04B 2/08
FR 1.272.187 * 8/1960
FR 2288935 A1 * 5/1976 ..... E04B 2/12
FR 3004177 A1 10/2014

(56) References Cited

FOREIGN PATENT DOCUMENTS

| | | | | | |
|---|---|---|---|---|---|
| GB | 1185021 | A | | 3/1970 | |
| JP | 3016672 | U | | 10/1995 | |
| JP | 2002143822 | A | | 5/2002 | |
| JP | 3138465 | U | | 1/2008 | |
| JP | 2011157690 | A | | 8/2011 | |
| JP | 2014015364 | A | | 1/2014 | |
| JP | 5826699 | B2 | | 12/2015 | |
| JP | 5888865 | B2 | | 3/2016 | |
| JP | 2016519038 | A | | 6/2016 | |
| KR | 20130009354 | A | * | 1/2013 | ..... E04B 2/42 |
| NL | 2007231 | C2 | * | 2/2013 | ..... E04B 1/046 |
| NO | 118996 | B | * | 3/1970 | ..... E04C 1/40 |
| WO | WO-8505140 | A1 | * | 11/1985 | ..... E04H 17/20 |
| WO | WO 2002079093 | A1 | | 10/2002 | |
| WO | WO-2010105317 | A1 | * | 9/2010 | ..... E04B 1/165 |

OTHER PUBLICATIONS

Written Opinion and International Search Report received in PCT Application No. PCT/US2020/019733, dated Jul. 29, 2020 in 9 pages.

* cited by examiner

INTERLOCKING COMPOSITE CONSTRUCTION BLOCK

CROSS REFERENCE

This application is a national stage application under 35 U.S.C. § 371 of PCT Application No. PCT/US2020/019733, filed Feb. 25, 2020, which claims the benefit of U.S. Provisional Application No. 62/919,084, filed Feb. 26, 2019. The entire contents of the above-identified patent applications are incorporated by reference herein.

BACKGROUND

Field of the Invention

The present invention relates in general to composite blocks for use in construction analogous to prefabricated concrete masonry units (CMU's) and in particular to construction blocks that will reduce the labor time and associated with constructing a wall.

Description of the Related Art

Concrete Masonry Units (CMU's) are a low-cost, durable, product used \worldwide for simple wall construction. Even though the blocks are low in cost they are labor-intensive to install and require skilled, expensive installers due to their need for manual alignment and mortar for adhesion and structural integrity. In addition the typical concrete used in CMU's is brittle and very heavy. Because of these factors, installation cost can be up to 10 times the purchase cost of blocks for wall construction. Also, the mechanical properties of concrete block material (about 14 MPa compression strength and about 300 MPa tensile strength) require reinforcement for most applications, at least in some portions of a wall. Most of a CMU wall is not load bearing except for certain areas reinforced with rebar and filled with concrete as necessary for the application.

There are multiple inventions that have been listed in prior art regarding CMU's. For instance, patent U.S. Pat. No. 6,167,669B1 for a Concrete Plastic Unit (CPU) describes a clear, permanent form, for steel reinforced concrete structures. Sections of the clear form are factory extruded, from a clear polyvinyl chloride material, so as to make the assembly of the forms, the installation of the steel and utilities, and the inspections that are required, easier. The clear forms will protect the steel reinforced concrete structures from the elements that cause these structures to fail. The clear form consists of two factory extended profiles that are totally different in shape. The sections that make up the form, can be modified, cut to any length or angle and assembled on site. It takes two sections, of one profile, to form both vertical sides of the form, and two sections, of the other profile, are horizontally inserted, between the vertical side sections, to create an elongated empty container. The assembled dear form is 7% inches wide and 8 inches high, and is open on four sides. The assembled units are installed horizontally, and can be stacked and connected, on top of one another, to conform to any design, for residential or commercial construction.

Another U.S. Pat. No. 6,213,754B1 is for a cementitious composition for the molding of ultra-lightweight, durable, large structural units comprising Portland cement, coal combustion byproducts, expanded or extruded polystyrene and water, and a modified block machine used in the manufacture of such structural units.

U.S. Pat. No. 4,566,238A for an energy conserving CMU describes a wall constructed to function as a passive thermal mass for energy storage permits enhanced solar heating and nocturnal cooling of the interior of a building using walls as disclosed. Use of an expansive insulating material, foamed in place, seals the wall to make it waterproof. Concrete masonry units having inner and outer cells are stacked to form the wall. A hardenable material poured into the inner cells of the masonry units moves both vertically and horizontally within the wall to form a rigid wall structure. Introducing insulation in fluid form into the outer cells adjacent to those containing the hardenable material disposes the insulation to lie essentially adjacent the thermal mass of the rigid inner wall structure.

U.S. Pat. No. 6,050,749A is for a Concrete masonry unit for reinforced retaining walls and describes a concrete masonry unit especially suited for use in soil reinforced retaining walls. The reinforced retaining wall is comprised of precast, concrete block masonry unit facing elements connected by suitable connectors to reinforcing members which extend from the facing elements into the adjacent reinforced soil to form a mechanically stabilized earthen wall construction. The connectors which affix the reinforcing members at their connecting ends to the facing elements comprise concrete poured into a part or all of certain of the void spaces within selective facing blocks, which concrete may or may not be reinforced and which concrete when dry and cured, envelops and secures the connecting ends of the reinforcement members to their corresponding blocks and forms anchors thereat. The novel masonry unit disclosed. herein effectively provides maximum facing area per unit volume (weight) of block, always exceeding 4.0 m2/m3, which results in considerable cost savings per unit of retaining wall surface area over conventional wall constructions.

Another patent US20170016228A1 for Surface Reinforced Concrete Masonry Units issued to the University of Manitoba is for a wall formed of masonry block units abutted with one another in series within stacked rows. Each masonry block unit is a concrete body having two opposing exterior side walls defining respective portions of the assembly masonry wall. Vertical reinforcement channels are formed in the exterior side 'Nalls of each masonry block unit so as to be open laterally to the exterior. The reinforcement channels align with corresponding channels in the masonry block units in adjacent stacked rows to receive elongate reinforcement members, for example rebar, inserted laterally therein from the exterior surface of the assembly masonry wall. A bonding material can then be recessed laterally into the reinforcement channels so as to bond the reinforcement members to the masonry assembly.

Another patent US20130205688A1 describes prefabricated. compound masonry units in lieu of build site-constructed elements, as well as methods of producing the same. One embodiment comprises a first course comprising hollow blocks laid end to end with adjacent ends adhered with mortar, the hollow blocks positioned such that the first course has a hollow core; at least one channel fomled in a top surface of the first course, the channel having a length; and provisional reinforcement provided along at least a portion of the length of the channel and held within the channel with a bonding material different from the mortar. The provisional reinforcement provides tensile strength to the first course for transportation and handling of the first course from a fabrication location to a build location where the first course is configured to receive permanent structural masonry reinforcement in the hollow core at the build location.

U.S. Pat. No. 3,005,282A issued in 1958 discloses the original patent for Lego™ toy building blocks. The patent describes building blocks, strips, or similar building parts to be assembled without the use of additional elements provided with complementary holes, grooves, or protuberances, e.g. dovetails with primary projections fitting by friction in complementary spaces between secondary projections, e.g. sidewalls.

There are multiple additional solutions that have been presented in prior art. Although the cementitious solutions offer improvements over standard CMU's they still suffer from limitations of being heavy, having poor impact properties, require manual alignment, require mortar for structural integrity and in general require skilled labor for alignment and installation.

The specific gravity of most block concrete is about 2.4 while the specific gravity of the thermoplastic composite blocks disclosed in this invention is less than 1.4. Also, while it is difficult to numerically compare due to the typical sample size differences, the impact properties of most thermoplastic natural fiber composites are well known to be significantly higher than that of low cost block concrete. The lower weight and better impact of natural fiber thermoplastic composites as described in the disclosed invention allow the molding of complex geometry with shells as thin as 3 mm. A block with similar shell thickness molded out of low cost block concrete would have significant breakage during transportation and installation.

Significant part of the structural integrity of standard CMU's and the prior art referenced here is due to the mortar. Unreinforced concrete walls perform poorly during earthquakes due to the low elongation before breaking which is typically significantly less than 0.5% while natural fiber thermoplastic composites show strains of between 2 and 6% before breaking. The disclosed invention does not require mortar for structural integrity due to the interlocking nature of the blocks. In addition to the lack of mortar they will align nearly perfectly due to the precise nature of a molded thermoplastic composite (typically less than +/−0.5 mm) and the disclosed design.

With respect to plastic building blocks such as Lego™ and other similar solutions disclosed herein and elsewhere, the significant differences are thermal expansion, creep, nature of assembly and geometry. Lego's and other similar blocks interlock through an interference fit where one or both parts deform during mating. This is possible with parts made of pure thermoplastics which can deform significantly before breaking (usually greater 10%) whereas thermoplastic composites like the design disclosed in this patent will typically break or be damaged at the deformation required for this kind of mating. The blocks in the disclosed invention mate with a clearance fit where no deformation is necessary.

Most thermoplastics like those used in Lego blocks have linear thermal expansion coefficients much greater than 0.0009/° C. Using a thermoplastic like this in large assemblies can exhibit significant deformations with normal temperature changes in building applications. These deformations can cause failure over time in the plastic or failure of the sealant or large gaps to appear depending upon if the assembly was made when the blocks were cold or warm. This effect is insignificant with small parts that are small. By contract the ideal thermoplastic natural fiber composite disclosed in this invention has a coefficient of thermal expansion less than 0.0002/° C. and will not exhibit this problem the same extent.

In addition to high thermal expansion, pure thermoplastics like those used in Lego™ blocks will have a tendency to creep. Especially with low-cost thermoplastics like polypropylene and polyethylene the creep can be significant under minimal loads at the temperatures seen in normal building applications. The same thermoplastics reinforced with about 50% natural fibers will typically exhibit an order of magnitude less creep.

Another significant difference between Lego™ blocks and the disclosed invention is the form of the molded blocks. Lego™ blocks are open on one side whereas the blocks in the disclosed invention are molded completely hollow. In addition Lego™ blocks interlock with an interference fit between the pins and the sidewall whereas the blocks in the disclosed invention interlock with lips and insets around the entire perimeter of each segment. The disclosed invention also has identical segments that can work on their own if separated, unlock Lego™ blocks. Also, Lego™ blocks do not have reinforcement capabilities provided by the holes in the disclosed invention or the interior accessibility provided by the open geometry of the disclosed invention.

The referenced current solutions that exist in the marketplace today, have difficult and time-consuming procedures for constructing walls. They are labor-intensive to install and require skilled, expensive installers due to their need for manual alignment and mortar for adhesion and structural integrity. Or, they are not suitable for the demanding requirements for most exterior wall applications.

None of the previous inventions and patents, taken either singly or in combination, is seen to describe the invention as claimed herein. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The primary desirable object of the present invention is to provide a novel and improved form of construction block analogous to Concrete Masonry Units (CMU's).

The main objective of the invention is to provide a remedy which poses improvement by having an improved methodology that can be used worldwide for construction of durable and low-cost walls.

It is further the objective of the invention to provide a methodology which minimizes the labor cost associated with constructing a block wall It is also the objective of the invention to provide a design for a multi-segment construction block that interlocks horizontally, vertically and orthogonally, and does not require mortar and is self-aligning.

It is also the primary objective of the invention to provide a solution that is ecological by using recycled plastic which has low embedded energy and locally produced natural fibers or agricultural waste.

It is further the objective of the invention to provide a solution which is easy to use and does not require specialized training.

It is moreover the objective of the invention to provide solution which is cost effective to install and has cost effective over the life of the construction.

Thus, it is the objective to provide a new and improved solution for effective building blocks in applications where Concrete Masonry Units (CMU's) are typically used. Other aspects, advantages and novel features of the present invention will become apparent from the detailed description of the invention when considered in conjunction with the accompanying drawings.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

DETAILED DESCRIPTION

Figure 1:
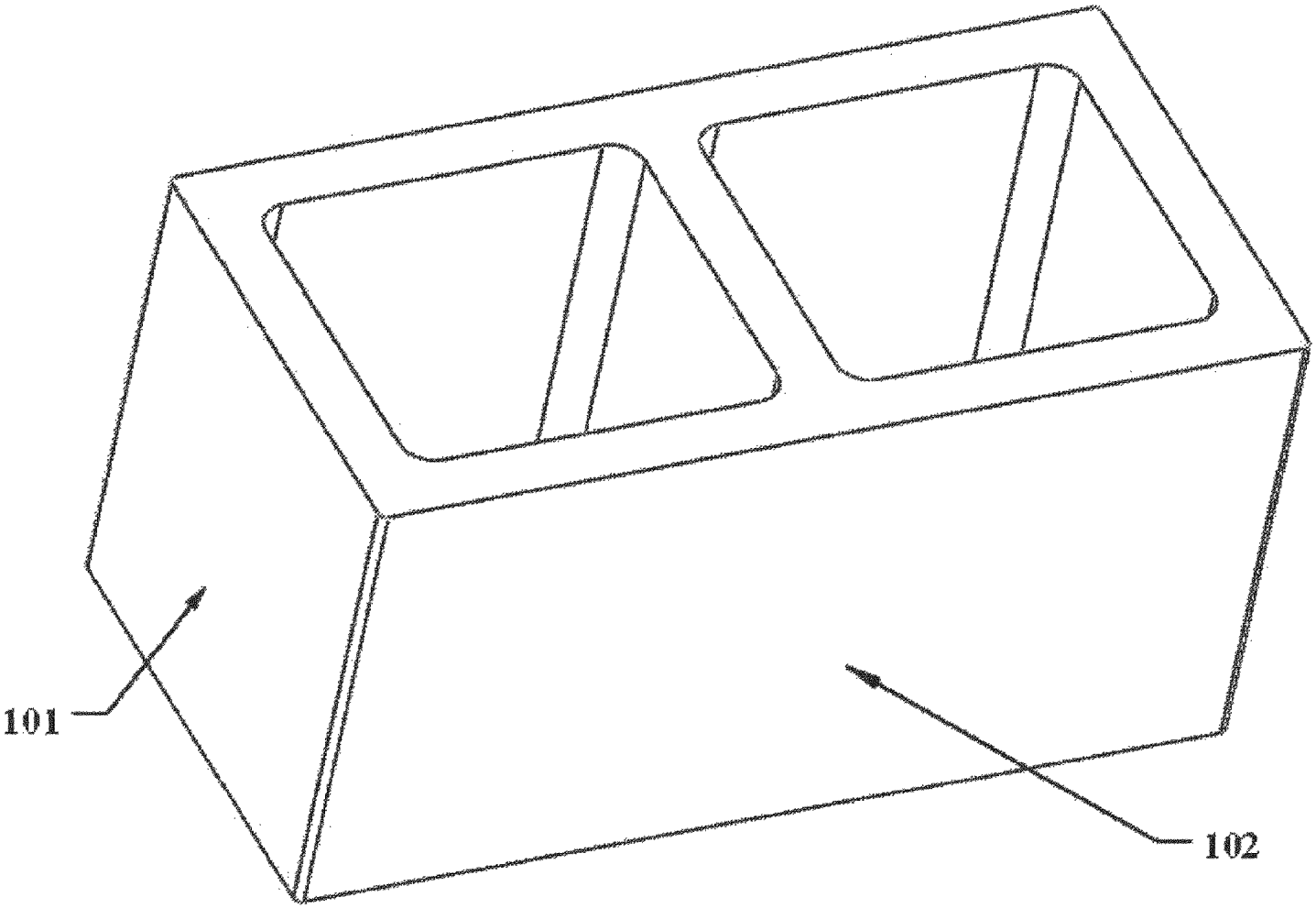
FIG. 1 PRIOR ART
FIG. 1 discloses the appearance of a typical CMU as per illustrative embodiments of the invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The use of the term "horizontal" is intended to mean the direction along the length of a wall. The use of the term "vertical" is intended to mean the direction perpendicular to the base plane of the installation, typically the ground. The use of the term "orthogonal" is intended to mean the direction 90 degrees to the horizontal direction of the wall. The use of the term "segment" is intended to mean a portion of a block that is equal in dimensions and form as all other segments that are connected laterally in a block. The use of the term "shell" is intended to mean the wall thickness of an individual block. The use of the term "wall" is intended to mean a barrier or planar separation in addition to the traditional meaning of the term. The term "wall thickness" is intended to mean the thickness of an entire block segment. The use of the term "CMU" is intended to mean the concrete masonry unit used in traditional concrete wall construction. The composition percentages referenced in this patent are all weight percent (%). Wood fiber is understood to be from trees such as pine, fir, bamboo etc. and not annual growth plants. The wood fiber referenced in this patent can be that recovered from pulp mill wastewater and contain adhered contaminants such as Calcium Carbonate. An "clearance fit" is intended to mean when there is a gap between pieces or parts pace making an assembly without having to deform either part like that in an interference type of fit such as a snap or press fit.

The present invention is intended to provide a methodology for reducing the labor cost associated with building walls similar to what would be constructed using concrete masonry units (CMU's). The design is for a multi-segment construction block that interlocks horizontally, vertically, and orthogonally, does not require mortar and is self-aligning.

The dimensions of the block as per its preferred embodiments are proposed to be similar to those of commercially available CMU's (FIG. 1) which are typically used to construct walls approximately 150 mm, 200 mm or 300 mm thick. The dimensions are not restricted to those listed here and can be anything that is manufacturable. Figure I shows the orientation of a typical CMU with the end of a block (101) and the exposed face (102) of a block.

Figure 2:
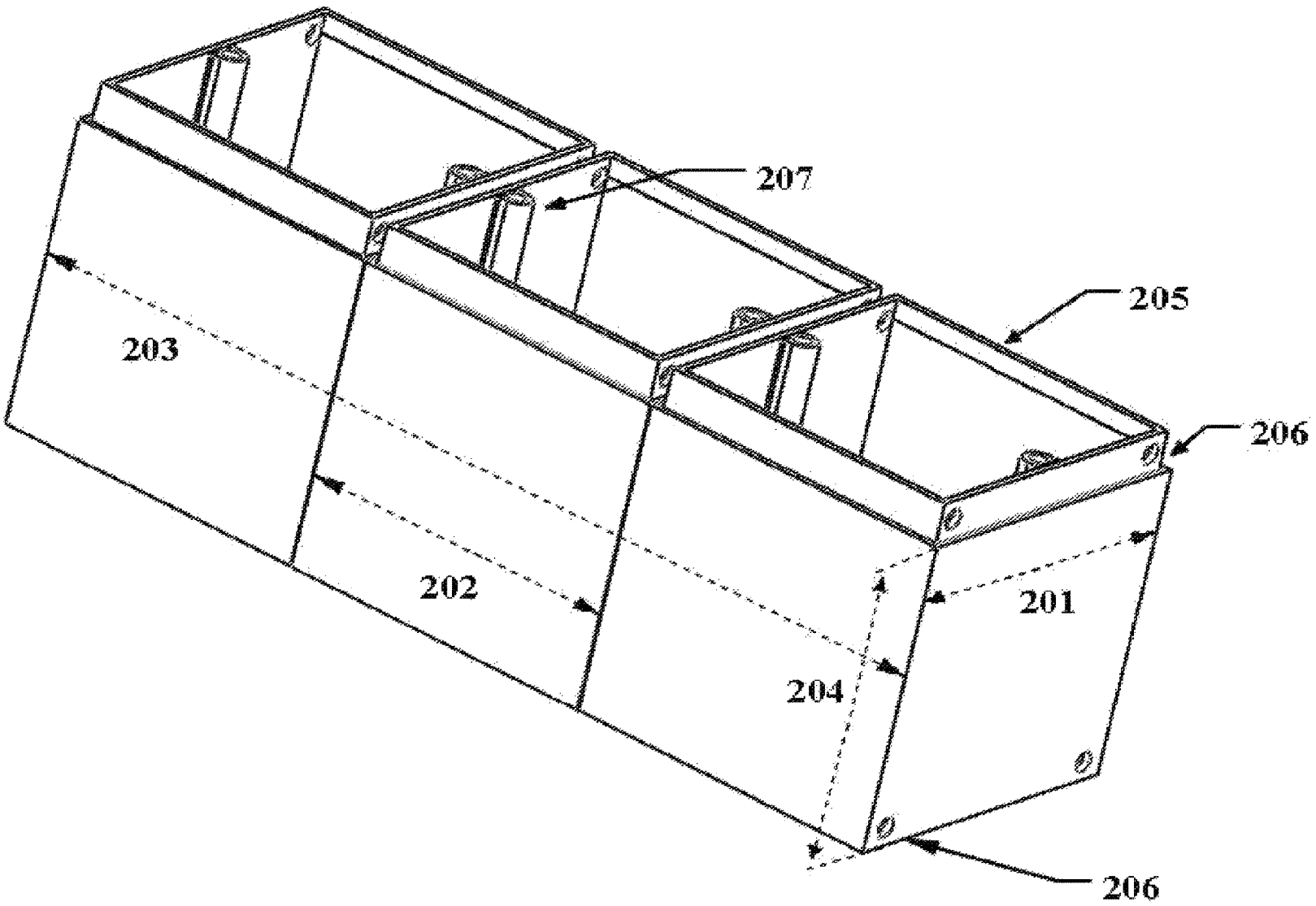
FIG. 2 discloses a single multi-segment block as per illustrative embodiments of the invention.

The block in the present invention is segmented with the width or thickness (201) of each segment equal to the length of each block segment (202). The length of the block (203) is an even multiple of the segment length. FIG. 2 shows a block with 3 segments. The exposed height of the block and segment (204) is normally the same as the segment length and width but can be any height.

Figure 4:
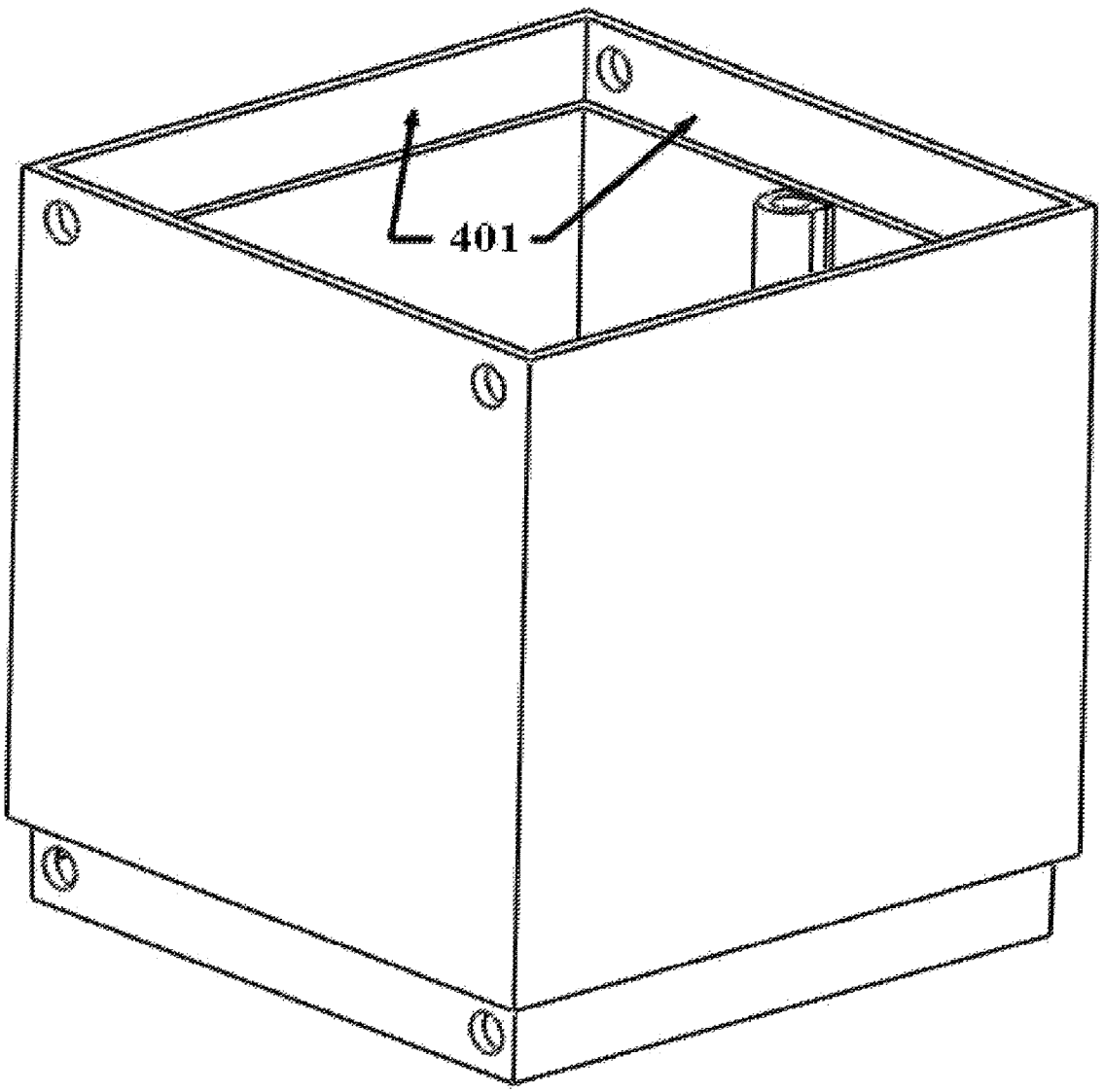
FIG. 4 discloses a single block segment with interlocking female inset around the segment perimeter as per illustrative embodiments of the invention.

Each segment has a male lip (205), (301) and a female inset (401) that span the perimeter of each segment and interlock vertically in a clearance fit with the male lips fitting into the female insets of each block. While the lip and inset are shown in FIG. 4 to span the entire perimeter of each segment it is not necessary and depends of the structural requirements of the particular application.

Each segment can have holes oriented horizontally (206) in the lip and inset areas so that when the blocks are interlocked the holes align horizontally. The holes are intended to accommodate rebar, bolts, rivets or pins to provide additional vertical and horizontal reinforcement as necessary. Each hole adjoining two blocks can have a bolt, rivet or other fastening device to firmly join only the two adjoining blocks. The holes can also be used as passages for wire, conduit and pipe to supply utilities along a wall. Additionally the blocks can have vertical passages (207) that can be used for mechanical reinforcement as necessary or as passages for utilities. Each segment is hollow and aligns with the segment below it allowing for clear passage from the top of the wall to the bottom. This passage can be filled with concrete or rebar or other reinforcing material as needed for the structural requirements of the application or can be filled with loose insulating material such as foam, rice hulls, cellulose, soil, rocks, etc. Block shell thicknesses (301) can be varied with the mold depending upon the mechanical requirements of the application and are typically less than 25 mm.

Figure 3:
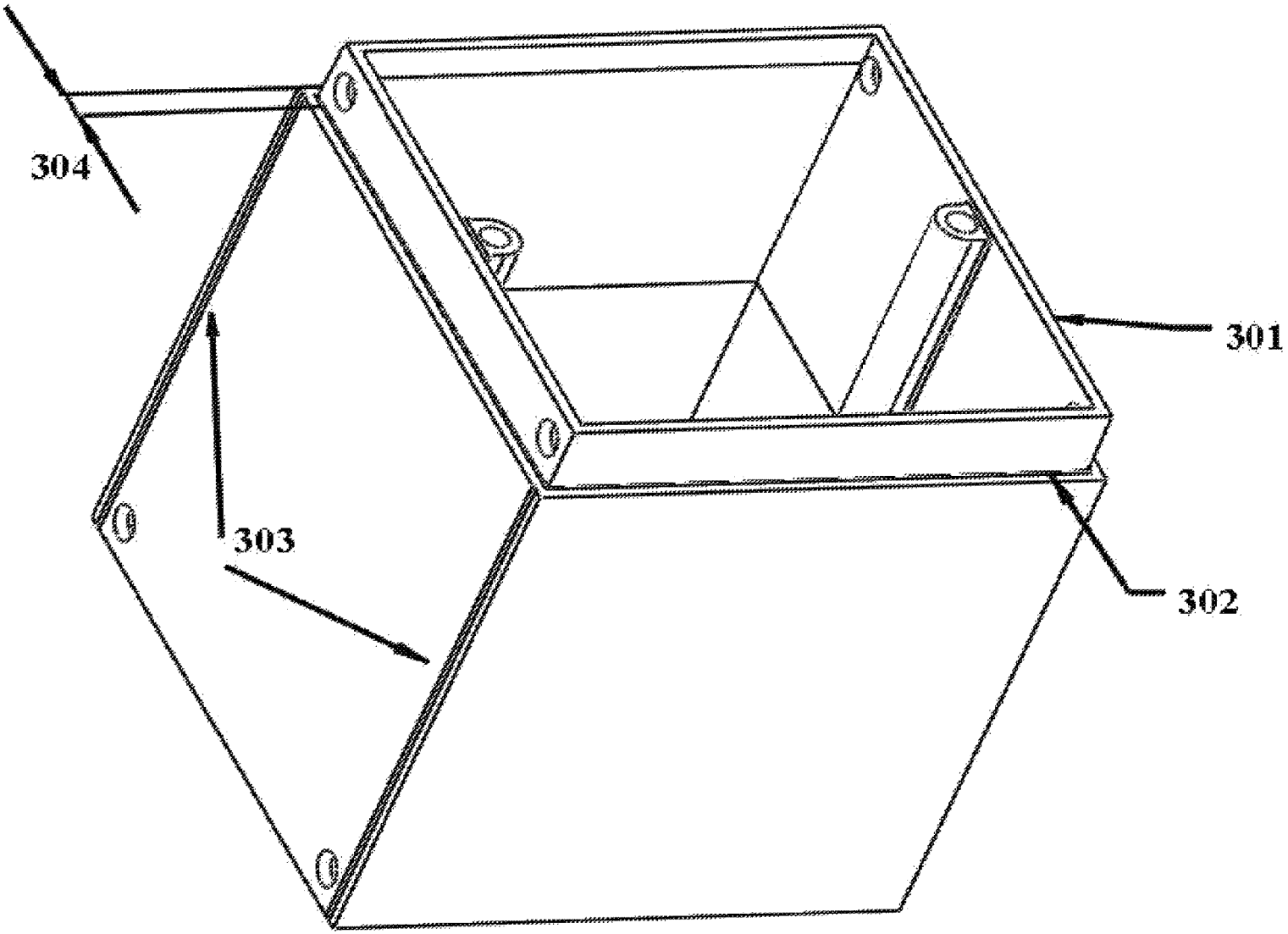
FIG. 3 discloses a single block segment with interlocking male lip around the segment perimeter as per illustrative embodiments of the invention.

The blocks do not require mortar or sealant or adhesive for structural integrity but they can be used between blocks during installation for additional structural reinforcement or weatherability as necessary. FIG. 3 shows the top of an individual segment with channels for (302), (303) for sealant, adhesive, an O-ring or gasket. FIG. 4 shows a corresponding female inset (401) on an individual segment.

Figure 5:
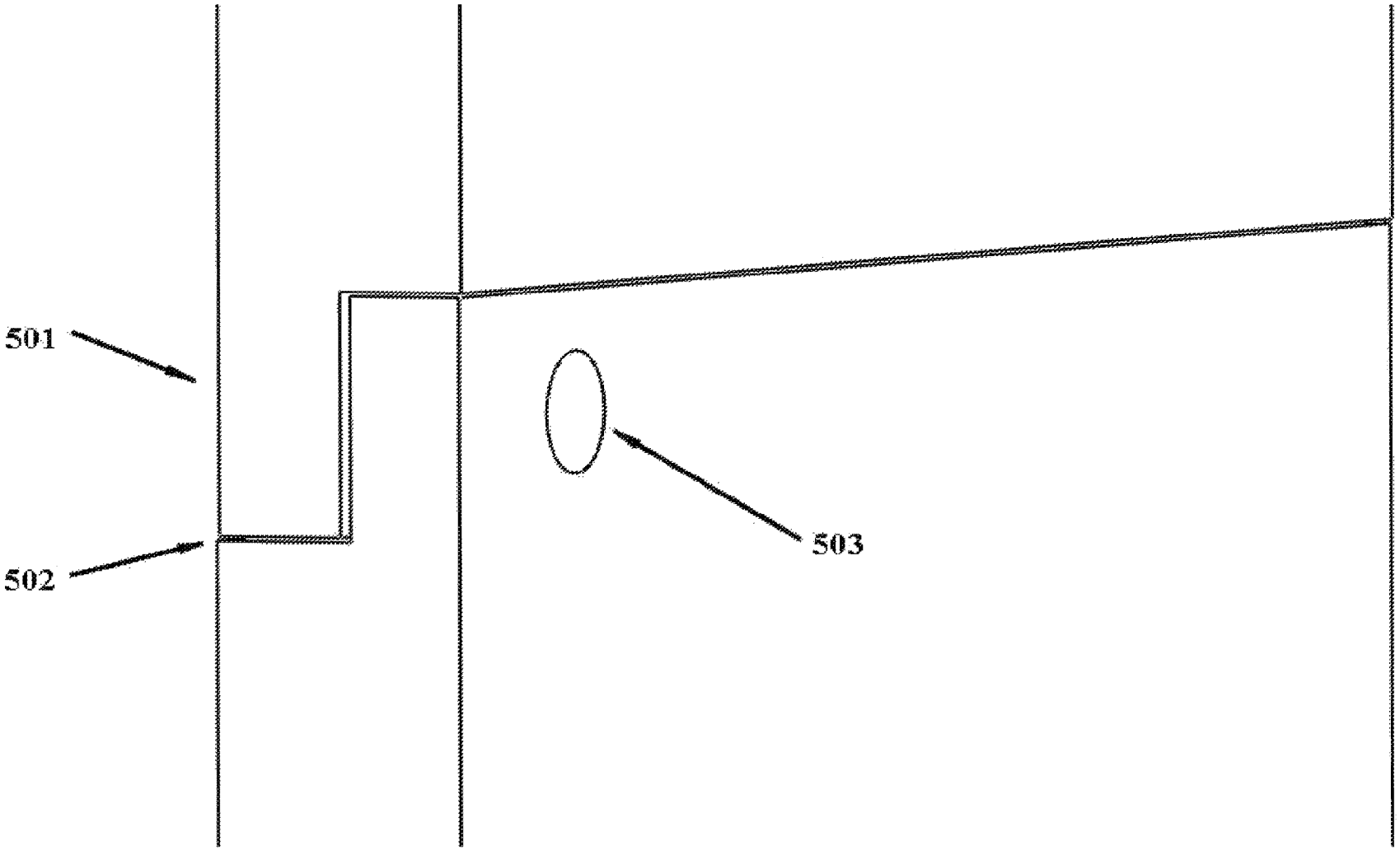
FIG. 5 discloses details of an interlocking male lip and female inset in an assembled wall segment wall as per illustrative embodiments of the invention.

FIG. 5 shows the interlocking detail of assembled blocks with the male lip (501) and female inset (502) as well as the location of a horizontally located hole (503) for reinforcement or for a passage.

Figure 6:
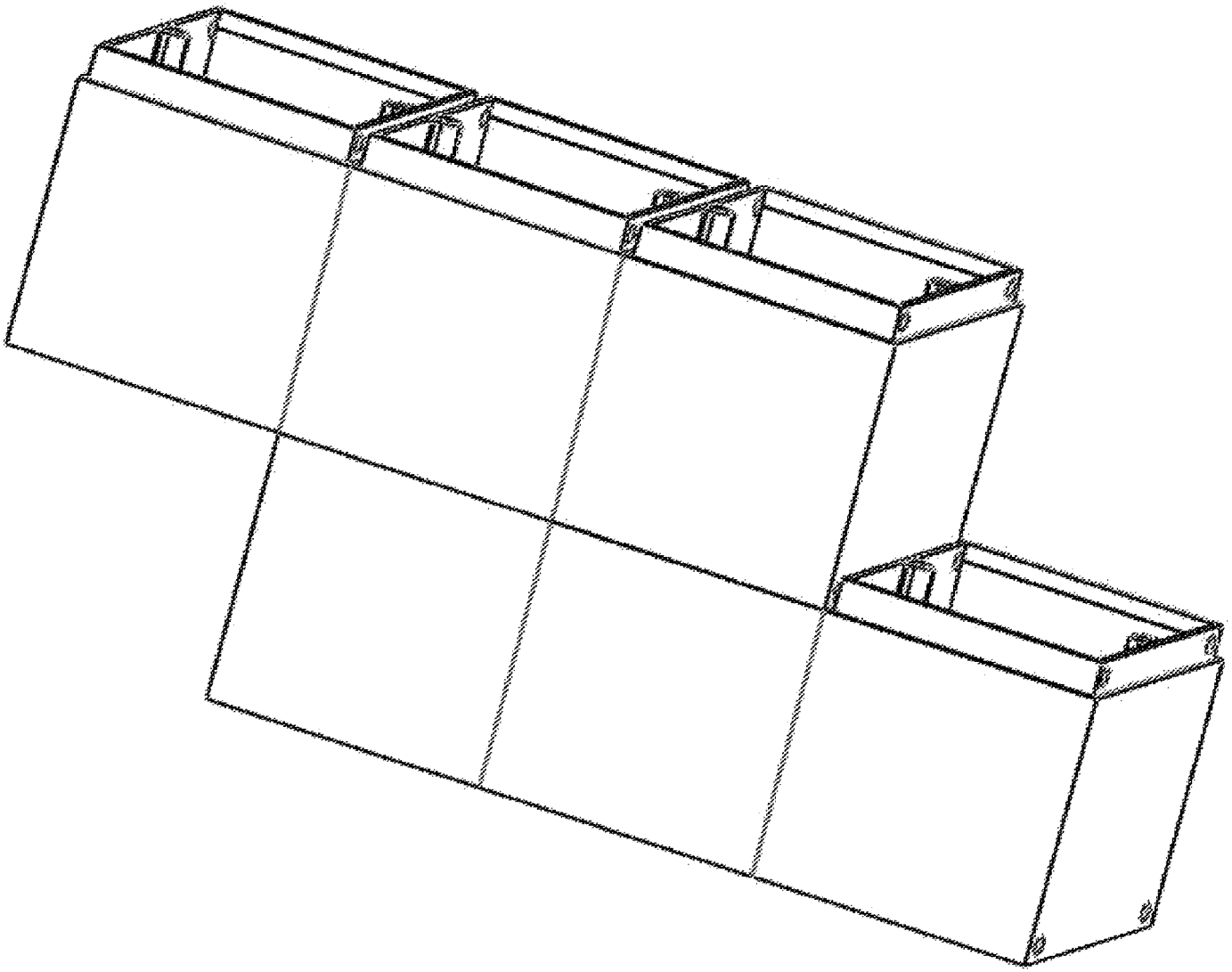
FIG. 6 discloses the two offset interlocking 3-segment blocks as per illustrative embodiments of the invention.

FIG. 6 shows two interlocking blocks with offset segments. While the blocks can be installed without offsetting the segments, an offset will provide additional structural integrity (especially in shear) as well as provide automatic alignment for the wall section.

Figure 7:
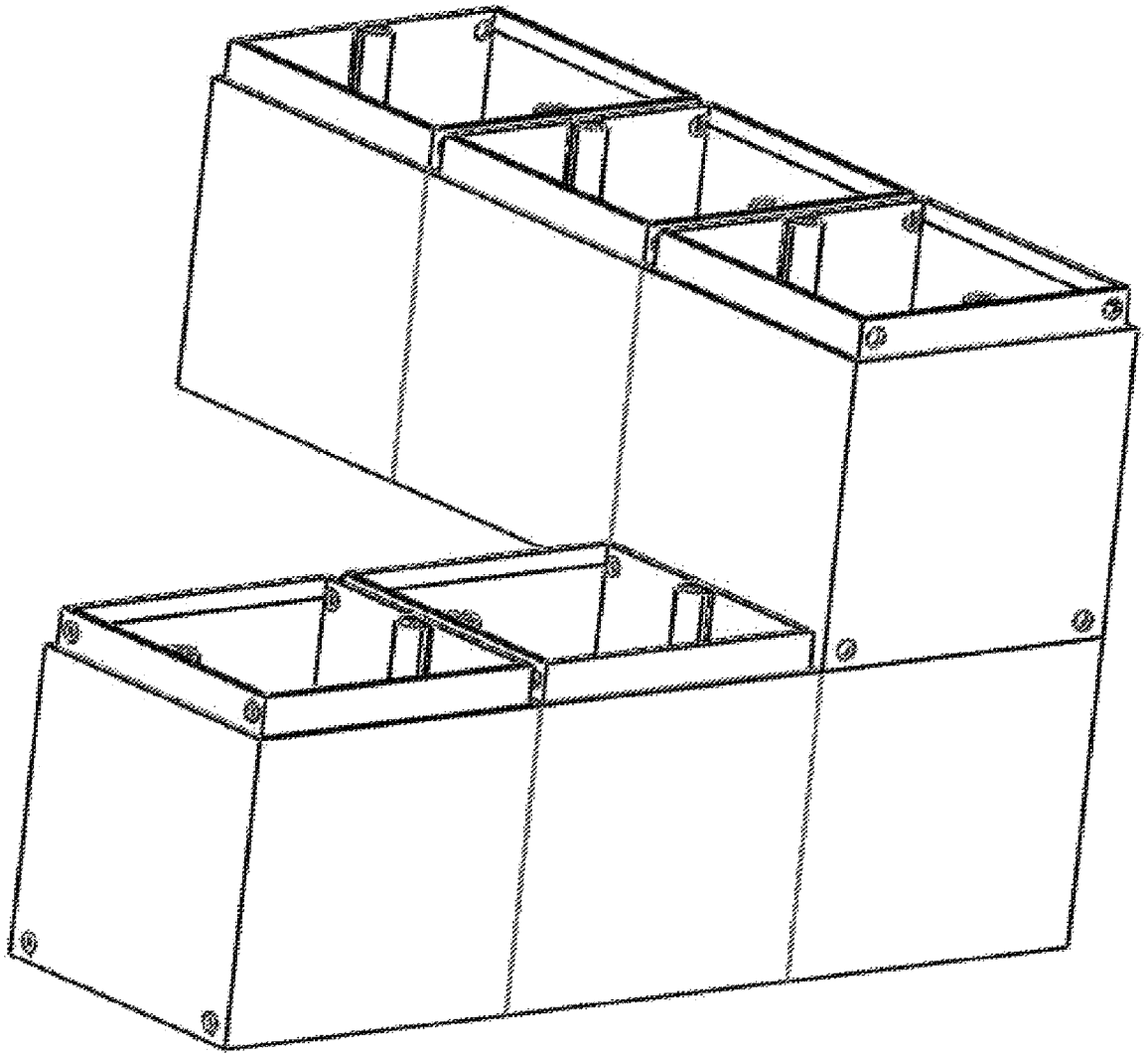
FIG. 7 discloses two orthogonally interlocking 3-segment blocks forming a corner as per illustrative embodiments of the invention.
Figure 8:
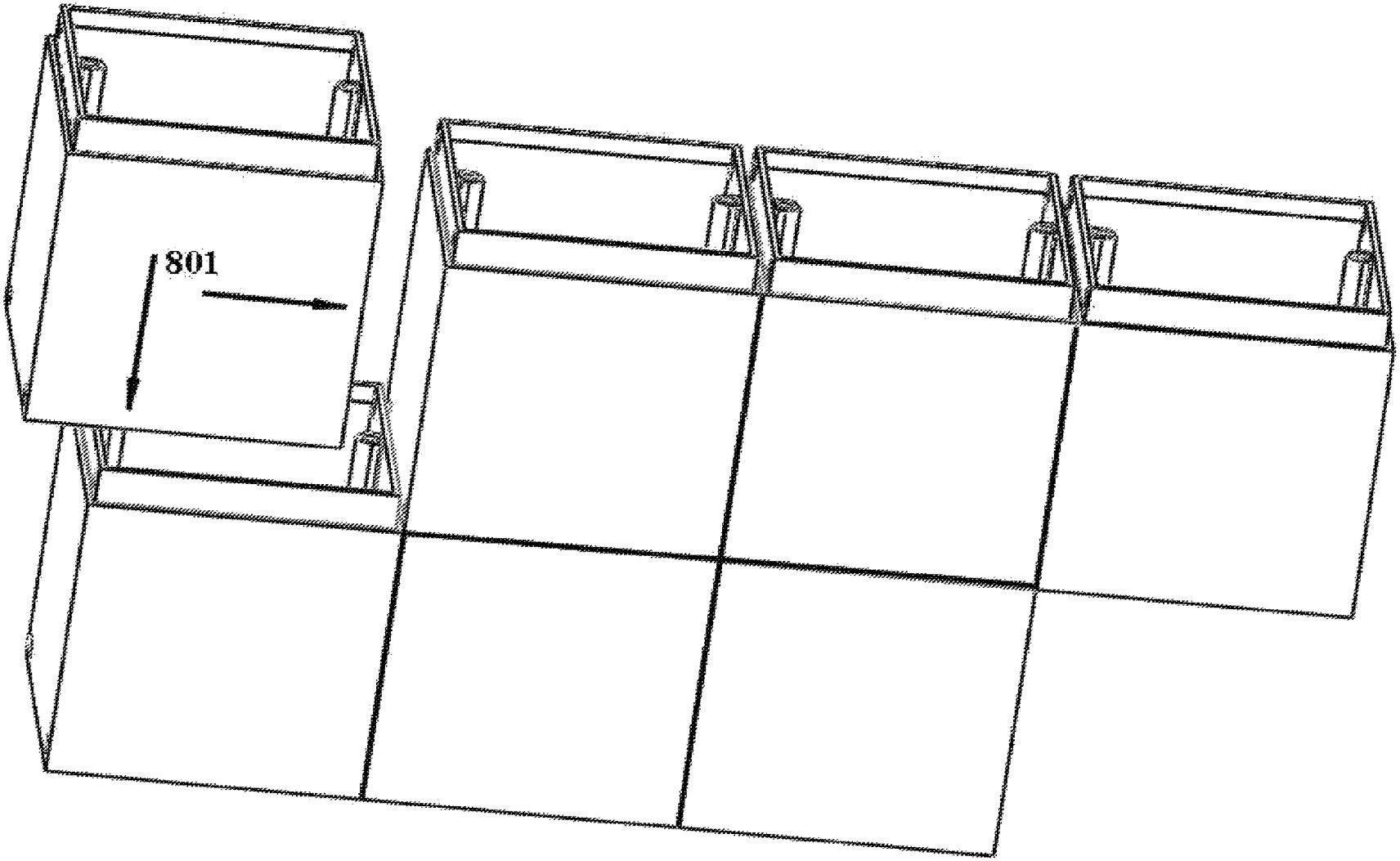
FIG. 8 discloses the two offset interlocking 3-segment blocks with single segment block to terminate a wall as per illustrative embodiments of the invention.

FIG. 7 shows two interlocking blocks oriented orthogonally to make a corner.

Because the blocks have multiple segments, individual segments may be necessary to complete a wall section and make the blocks line up vertically even at the end. Individual blocks may be manufactured for this purpose or multi-segment blocks can be cut between segments to make single segment blocks. FIG. 7 shows a wall section utilizing a single segment block (801)

Figure 9:
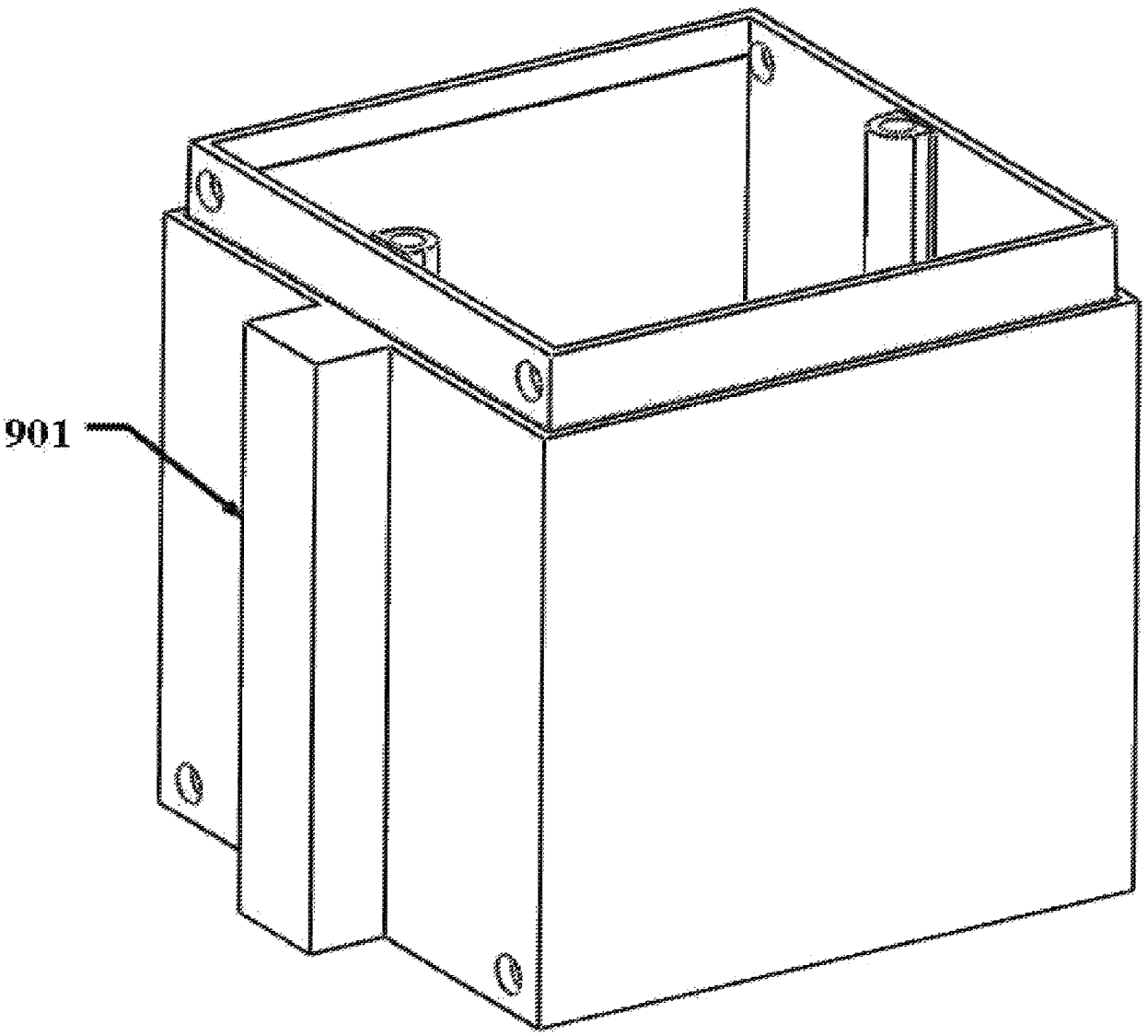
FIG. 9 discloses a single segment block with a protrusion on an end face for locating windows or doors as per illustrative embodiments of the invention.

FIG. 9 shows a version of the block with an end face that has a vertical protrusion (901) that can be used to complete walls where a window or door opening is desired. The protrusion can be used to aid in the installation of windows or doors by providing a fastening guide. Additionally, special blocks can be made that have protrusions similar to (901) but located on the exposed top or bottom of a block where a window or door will be installed. Special blocks with sealed top or bottom surfaces may also be fabricated for starting the bottom of a wall or terminating the top of a wall but with a corresponding interlocking lip or inset to allow connecting with the corresponding blocks above or below.

Blocks can also have ports for water fixtures or wiring outlets as desired which can be configured from the inside of a block due to the accessibility provided by the hollow nature of each segment.

Figure 10:
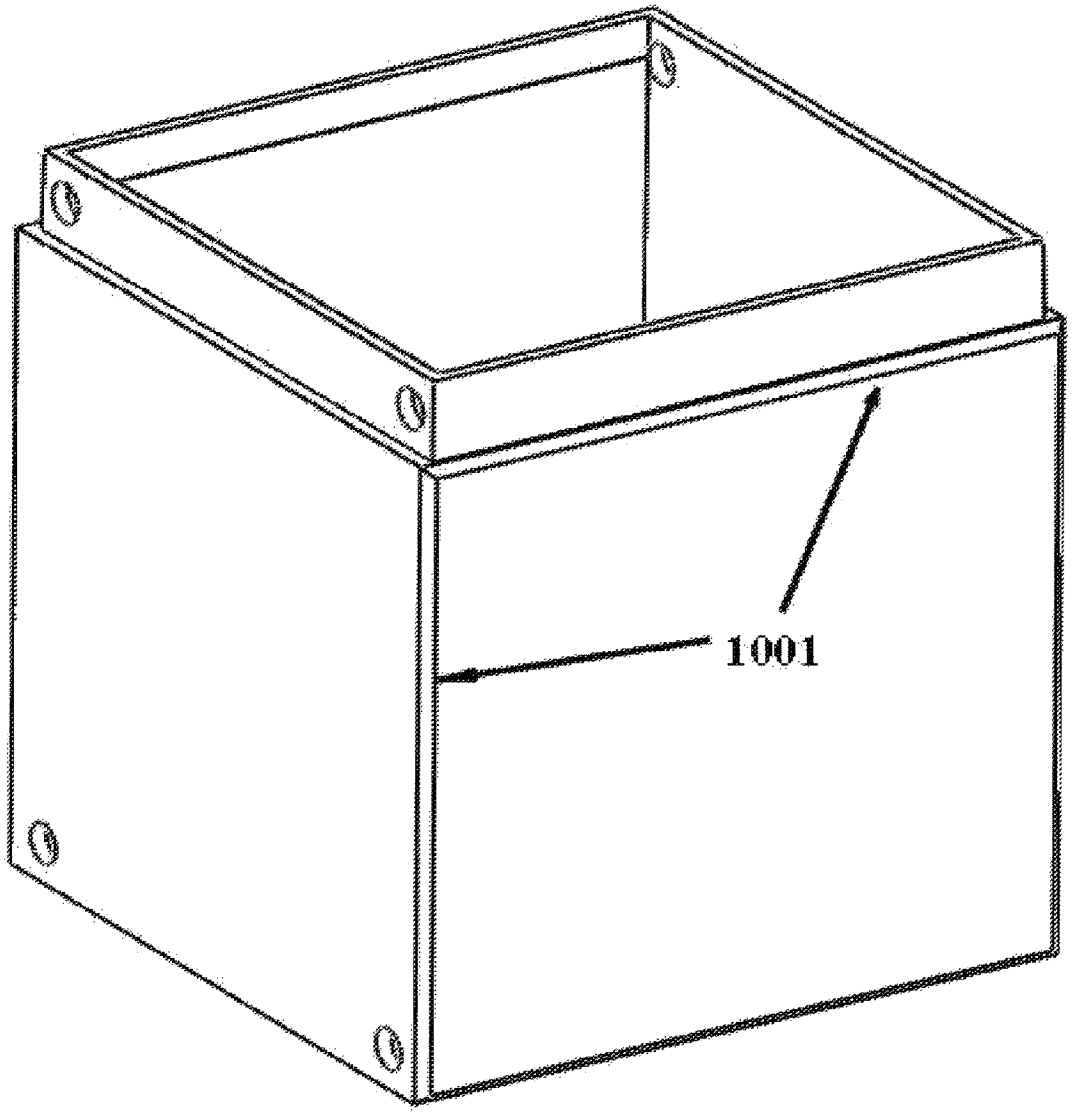
FIG. 10 discloses the chamfers on the exposed face of a block as per illustrative embodiments of the invention.

FIG. 10 shows the exposed face of a block with optional chamfers (1001) that may be desired to aid in sealing the wall from water intrusion.

To compete with CMU's the blocks need to be made from a low-cost material with strength equal or greater than that of concrete and have a low coefficient of thermal expansion. The blocks may be made by compression molding, blow molding, rota-molding or injection molding with some post-molding operation such as hole drilling or eliminating exterior molding draft necessary.

Although any moldable material can be used for this invention, probably the best mechanical properties per unit cost would be a natural fiber reinforced thermoplastic composite. The ideal material would be molded from a composite of natural or synthetic fibers Gute, wood, flax, kenaf, cotton, hemp, bamboo, cellulose, ramie, banana, etc.) and thermoplastics (polyolefins, nylon, PVC, polyesters, PLA, etc.) The ideal natural fiber thermoplastic composite material would have a compression strength greater than 60 MPa and a coefficient of linear thermal expansion (CLTE) less than 0.0002/° C. With a compression strength of >4 times that of the typical concrete block material (about 14 MPa), these natural fiber thermoplastic composite materials will allow the design of a block based on compression strength with ¼ the shell thickness of a typical concrete block if creep is not an issue.

The natural fiber composite formulation can include additives such as pigments (iron and other metal oxides, zinc ferrite, carbon black, titanium dioxide, etc.), UV light stabilizers (HALS, titanium dioxide, carbon black, nickel quenchers, benzophenones, benzotriazoles), antioxidants (hindered phenols, phosphites, thioesters, heat stabilizers; (organophosphites, hindered phenols), fungicides (zinc borate, microban.), coupling agents (maleated polyolefins, maleic acid grafted styrene-ethylene-butadiene, silanes) and fire retardants (magnesium hydroxide, alumina trihydrate, borates). If the exposed part of the board is coated or not exposed to light or fire, the UV stabilizers, pigments and fire retardants are not necessary.

Alternatively, depending upon the demands of the application, the blocks can be made from recycled plastics including polyolefins, nylon, PVC, polyesters and mixtures thereof With mixtures of different types of plastic a suitable coupling agent or compatibilizer such as a silane or maleic acid grafted polymer or suitable block copolymers containing segments that are compatible with the different polymers in the mix. Styrene ethylene butylene styrene triblock copolymer (SEBS) is one compatabilizer that can improve properties of polymer blends. Natural, synthetic or mined particles such as talc, calcium carbonate, clay, mica, carbon and nanoparticles of these minerals, rice hulls, flax shive, wood sawdust, bagasse, core from hemp or kenaf, etc. may also be used instead of fibers. Recycled natural and synthetic fibers recovered from mattresses, furniture or carpets will also work.

A more typical natural fiber thermoplastic composite with recycled plastic and fillers rather than fibers might have coefficient of linear thermal expansion less than 0.0003/° C. and compression strength greater than 40 MPa which would be suitable for many block applications.

In some instances, synthetic fibers such as glass, Kevlar and basalt may be cost effective as well as using a thermoset resin with catalyst such as an epoxy or polyester resin.

If creep is an issue, it may be desirable to cross-link the thermoplastic to prevent movement, especially under sustained loads and high temperatures. High density polyethylene is particularly suitable for cross-linking and can be performed in the mold if the temperature of the composite in the mold is high enough for the cross-linking to initiate. There are many cross-linking agents but for high density polyethylene (HDPE), tert butyl cumyl peroxide (BCUP) is commonly used at a composition of 2% of the weight of the polyethlene. Polypropylene and other thermoplastics have their particular cross-linking agents that may also be suitable for molding thermoplastic natural fiber composite blocks.

While specific embodiments have been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A segmented thermoplastic composite construction block comprising:

a plurality of segments, each segment having a segment length, a segment width equal to the segment length, a first open end, a second open end opposite the first open end, and a hollow interior;

interlocking features located at the first and second open ends of each segment, wherein the block is configured to interlock with adjacent blocks horizontally, vertically, and orthogonally, wherein the interlocking features of each segment comprises a lip and an inset, the lip formed at and surrounding a perimeter of the first open end, the inset formed at and surrounding a perimeter of the second open end, the lip and inset configured to provide a clearance fit with corresponding features on adjacent blocks; and wherein the lip includes a first hole and a second hole, the first and second holes arranged on opposite sides of the lip and facing one another, the first and second holes configured to allow a first reinforcement element to be inserted through the opposite sides of the lip and the hollow interior; and wherein the inset includes a first hole and a second hole, the first and second holes of the inset arranged on opposite sides of the inset and facing one another, the first and second holes of the inset configured to allow a second reinforcement element to be inserted through the opposite sides of the inset and the hollow interior.

2. The segmented thermoplastic composite construction block of claim 1, wherein each segment includes vertically oriented channels capable of aligning with a vertically oriented channel of an adjacent interlocking block configured to receive rebar or other reinforcements.

3. The segmented thermoplastic composite construction block of claim 1, wherein the segmented thermoplastic composite construction block comprises polyethylene.

4. The segmented thermoplastic composite construction block of claim 1, wherein the segmented thermoplastic composite construction block comprises cross-linked polyethylene.

5. The segmented thermoplastic composite construction block of claim 1, wherein the segmented thermoplastic composite construction block comprises polypropylene.

6. The segmented thermoplastic composite construction block of claim 1, wherein the segmented thermoplastic composite construction block comprises hemp fiber.

7. The segmented thermoplastic composite construction block of claim 1, wherein the segmented thermoplastic composite construction block comprises wood fiber derived from pulp mill waste.

8. The segmented thermoplastic composite construction block of claim 1, wherein the segmented thermoplastic composite construction block comprises rice hulls.

9. An assembly comprising the segmented thermoplastic composite construction block of claim 1 and said first and second reinforcement elements, wherein each of said first and second reinforcement elements comprises rebar.

10. An assembly comprising:

a first composite construction block including a first segment comprising:

a plurality of walls, a first open end, a second open end, and a hollow interior;

a lip formed along and surrounding a perimeter of the first open end; and a first hole and a second hole, the first and second holes extending through opposite sides of the lip and facing one another; and a second composite construction block configured to be stacked atop a portion of the first composite construction block, the second composite construction block including a second segment comprising:

a plurality of walls, a first open end, a second open end, and a hollow interior;

an inset formed along interior surfaces of the plurality of walls at the second open end of the second segment and surrounding a perimeter of the second open end of the second segment; and a first hole and a second hole, the first and second holes of the second segment extending through opposite sides of the inset and facing one another;

wherein, when the second composite construction block is stacked atop the portion of the first composite construction block, the lip is arranged within the inset and the first and second holes of the first and second segments align with one another to allow a reinforcement element to be inserted through the lip, the inset, and the hollow interiors of the first and second segments of the first and second composite construction blocks.

11. The assembly of claim 10, wherein the lip is configured to fit within the inset via a clearance fit.

12. The assembly of claim 10, wherein the lip and inset are sized and shaped to allow removable engagement of the lip within the inset.

13. The assembly of claim 10, wherein the lip comprises a length and a uniform thickness along an entirety of the length of the lip, and wherein the inset comprises a length and a uniform depth along an entirety of the length of the inset.

14. The assembly of claim 10, wherein the first and second composite construction blocks are configured such that, when the lip is arranged within the inset:

the first hole of the first composite construction block is arranged adjacent to the first hole of the second composite construction block; and the second hole of the first composite construction block is arranged adjacent to the second hole of the second composite construction block.

15. A composite construction block comprising at least one segment, the at least one segment comprising:

a plurality of walls connected to one another, a first open end, a second open end opposite the first open end, and a hollow interior;

a lip formed along and surrounding a perimeter of the first open end;

an inset formed along interior surfaces of the plurality of walls at the second open end and surrounding a perimeter of the second open end;

a first hole and a second hole, the first and second holes extending through opposite sides of the lip and arranged to face one another, the first and second holes configured to allow a first reinforcement element to be inserted through the opposite sides of the lip and the hollow interior; and a third hole and a fourth hole, the third and fourth holes extending through opposite sides of the inset and arranged to face one another, the third and fourth holes configured to allow a second reinforcement element to be inserted through the opposite sides of the inset and the hollow interior.

16. The composite construction block of claim 15, wherein said first and second holes are coaxially aligned about a first axis and wherein said third and fourth holes are coaxially aligned about a second axis that is parallel to the first axis.

17. The composite construction block of claim 15, wherein the lip comprises a length and a uniform thickness along an entirety of the length of the lip, and wherein the inset comprises a length and a uniform depth along an entirety of the length of the inset.

18. An assembly comprising:

a first composite construction block comprising:

a first segment comprising a first open end, a second open end, a hollow interior, a lip extending along and surrounding a perimeter of the first open end, and a first pair of holes located in the lip and facing one another; and a second segment comprising a first open end, a second open end, a hollow interior, a lip extending along and surrounding a perimeter of the first open end of the second segment, and a second pair of holes located in the lip of the second segment and facing one another;

a second composite construction block configured to be stacked atop a first portion of the first composite construction block, the second composite construction block comprising:

a third segment comprising a first open end, a second open end, a hollow interior, an inset formed at and surrounding a perimeter of the second open end of the third segment, and a third pair of holes located in the inset and facing one another, wherein the inset is configured to receive the lip of the first segment; and a third composite construction block configured to be stacked atop a second portion of the first composite construction block, the third composite construction block comprising:

a fourth segment comprising a first open end, a second open end, a hollow interior, an inset formed at and surrounding a perimeter of the second open end of the fourth segment, and a fourth pair of holes located in the inset of the fourth segment and facing one another, wherein the inset of the fourth segment is configured to receive the lip of the second segment; and wherein, when the second and third composite construction blocks are stacked atop the first and second portions of the first composite construction block, the lips of the first and second segments are arranged within the insets of the third and fourth segments and the first, second, third, and fourth pair of holes align with one another and are configured to allow a reinforcement element to be inserted through the lips and insets to inhibit separation of the first, second, and third composite construction blocks from one another.

19. The assembly of claim 18, wherein the lips of the first and second segments of the first composite construction block are separated from one another by a gap that is sized to receive a portion of a wall of the second composite construction block and a portion of a wall of the third composite construction block.

20. The assembly of claim 18, wherein:

the lip of the first segment comprises a length and a uniform thickness along an entirety of the length of the lip of the first segment;

the lip of the second segment comprises a length and a uniform thickness along an entirety of the length of the lip of the second segment;

the inset of the third segment comprises a length and a uniform depth along an entirety of the length of the inset of the third segment; and the inset of the fourth segment comprises a length and a uniform depth along an entirety of the length of the inset of the fourth segment.

* * * * *